US005505800A

United States Patent [19]

Harries et al.

[11] Patent Number: 5,505,800

[45] Date of Patent: Apr. 9, 1996

[54] EXPLOSIVES

[75] Inventors: Gwyn Harries, Melbourne; David P. Gribble, Perth; Gary N. Lye, Kalgoorlie, all of Australia

[73] Assignee: Technological Resources Pty Ltd., Australia

[21] Appl. No.: 98,381

[22] PCT Filed: Feb. 11, 1992

[86] PCT No.: PCT/AU92/00050

§ 371 Date: Jan. 21, 1994

§ 102(e) Date: Jan. 21, 1994

[87] PCT Pub. No.: WO92/13815

PCT Pub. Date: Aug. 20, 1993

[30] Foreign Application Priority Data

Feb. 11, 1991 [AU] Australia ..... PK4556

[51] Int. Cl.[6] ..... C06B 31/28

[52] U.S. Cl. ..... 149/46; 149/109.6

[58] Field of Search ..... 149/46, 109.6

[56] References Cited

U.S. PATENT DOCUMENTS

| | | | |
|---|---|---|---|
| 1,743,172 | 1/1930 | Ward | 149/46 |
| 1,895,144 | 1/1933 | Botts et al. | 149/46 |
| 2,107,157 | 2/1938 | Lewis et al. | 52/14 |
| 2,218,563 | 10/1940 | Taylor et al. | 52/14 |
| 2,324,363 | 7/1943 | Cobb, Jr. | 52/11 |
| 2,602,732 | 7/1952 | Farr | 52/11 |
| 3,135,634 | 6/1964 | Moore | 149/19 |
| 3,713,917 | 1/1973 | Cook et al. | 149/20 |

FOREIGN PATENT DOCUMENTS

| | | |
|---|---|---|
| 15619/83 | 12/1983 | Australia . |
| 600758 | 9/1986 | Australia . |
| 82431/87 | 6/1988 | Australia . |
| 51256/90 | 9/1990 | Australia . |
| 0330637 | 2/1989 | European Pat. Off. . |
| 1351348 | 3/1963 | France . |
| 1370801 | 7/1963 | France . |
| 588362 | 5/1947 | United Kingdom . |
| 882665 | 11/1961 | United Kingdom . |
| 970975 | 9/1964 | United Kingdom . |
| 1270319 | 4/1972 | United Kingdom . |

OTHER PUBLICATIONS

International Search Report for PCT/AU92/00050.

6001 Chemical Abstracts, 115 (1991) Jul. 15, No. 2, Columbus, Ohio, US Abstract No. 11879n.

Supplementary European Search Report Application No. EP 92 90 4970.

*Primary Examiner*—Ngoclan Mai
*Assistant Examiner*—Anthony R. Chi
*Attorney, Agent, or Firm*—Merchant, Gould, Smith, Edell, Welter & Schmidt

[57] ABSTRACT

An explosive composition comprising an oxidising agent such as ammonium nitrate (AN), and a fuel material which may include a fuel oil (FO) and which also comprises a solid fuel such as rubber particles or polystyrene beads or flakes. The solid fuel is incorporated into the composition to provide for the controlled release of energy upon detonation of the explosive composition. It has been found that by substituting some or all of the liquid fuel oil with a slower burning solid fuel, the time during which the pressure builds up during detonation is lengthened. Thus a low shock energy explosive (LSEE) can be produced having reduced shock energy and increased heave energy compared to convention explosives, such as ANFO.

25 Claims, 1 Drawing Sheet

EXPLOSIVES

FIELD OF THE INVENTION

The present invention relates to explosives in general, and in particular to modified forms of high shock explosives used in rock blasting situations. The modified explosives are so called low shock energy explosives (LSEE). More particularly, the present invention relates to low shock energy explosives for use in rock or mineral blasting situations and to methods of mining using such explosives. Even more particularly, though not exclusively, the present invention relates to the manufacture and use of chemically modified forms of Ammonium Nitrate Fuel Oil (ANFO) explosives which have been modified, preferably by the incorporation of a slower reacting solid fuel material, for delaying the time taken for the development of the maximum amount of energy of the explosive.

Although the present invention will be described with particular reference to the use of modified ANFO explosives in rock blasting, it is to be noted that the present invention is not limited to the production and use of this type of explosive, but rather the scope of the present invention is more extensive so as to also include materials, modifications and uses other than those specifically described. For example, the present invention is equally applicable to the so called heavy or high-density ANFO/EMULSION high shock energy explosive. The modification of heavy ANFO/EMULSION explosive by the incorporation of a solid fuel material can produce a similar shift in the energy balance to create a LSEE.

BACKGROUND TO THE INVENTION

Explosives currently being used in rock blasting situations are generally high shock energy explosives in which all of the explosive energy and the attendant high-pressure gases are generated more or less instantaneously. A typical example of such an explosive which is currently used is ANFO which is a mixture of ammonium nitrate (AN) and vegetable and mineral oils with flash point greater than 140° F., typically diesel oil No.2 (FO). The use of ANFO explosives in many blasting situations results in a number of disadvantages which include the following:

(i) The explosive releases energy in two main forms—shock, and heave energy. At detonation there is a sudden increase of pressure that displaces the blasthole wall, generating a strain, or shock, wave that produces cracks in the rock. The energy in this wave is the shock energy. After the shock wave has propagated through the rock, the hot pressurised gas which is left in the blasthole is able to extend the cracks as well as to heave the burden. The gas has an energy content called the heave energy. Before blasting, rock generally contains sufficient fractures that can be propagated by the heave energy alone. Thus the shock energy serves little or no useful purpose in fractured rock. For ANFO 94/6 (94% Ammonium Nitrate/6% Fuel Oil), the total energy theoretically available is 3727 J/g, which comprises 1241 J/g shock energy, 2255 J/g heave energy and 231 J/g of residual energy, where the residual energy is the internal energy of the gas itself and cannot be utilised.

(ii) Due to the high shock energy generated by the explosion a greater proportion of fine rock particles (fines) are produced by the shock wave crushing the rock located in close proximity to the borehole more than is desirable or is required, such as for example, for use in further processing steps.

(iii) Minerals, or other materials of economic value, such as for example, diamonds which are to be extracted from the rock are sometimes damaged by the crushing of diamond bearing rock caused by the shock wave, particularly in locations close to the blasthole.

It is thought that the development of a low shock energy explosive in which more of the energy of the explosive is generated as heave energy and less as shock energy, and where the energy is more gradually released, may alleviate at least some of the problems associated with the use of conventional high shock energy explosives. Therefore, it is an aim of the present invention to provide a modified explosive, particularly a modified high shock energy explosive which is useful in blasting, in which the production of shock energy is reduced somewhat when compared to conventional blasting explosives.

Previous attempts to produce a LSEE involved dilution of the explosive mixture to produce a lower bulk energy for a given mass of explosive mixture. In general, previous attempts have resulted in low shock, low bulk energy explosives which necessitates the drilling of more blastholes. For example, ANFORGAN is a known form of LSEE that consists of a mixture of ANFO and sawdust, typically in the ratio of about 2:1. The sawdust acts as a diluent for the ANFO which reduces the density of the explosive mixture. It is well known that the shock energy of an explosive decreases as its density decreases. The problem with reducing the density of the explosive is that in a blasthole the amount of explosive is limited by the volume of the hole. A low density explosive will not have as much mass in a given volume as a high density explosive. Since the effects of the explosive are related to the amount of explosive in the hole, a low density explosive will not break the rock as effectively as a high density explosive. It is an object of the present invention to lower the shock energy but to keep the total energy at a level comparable to a conventional explosive, such as ANFO.

SUMMARY OF THE INVENTION

According to the present invention there is provided an explosive composition comprising an oxidizing agent in solid particle form and a fuel material, wherein said fuel material includes a non-absorbent solid fuel material incorporated into the composition in particulate form, the weight ratio of the oxidizing agent to the fuel material being in the range of 85:15 to 99:1, and the percentage by weight of the solid fuel material is set between 1 to 15% of the total weight of the composition, the balance, if any, of the fuel material comprising a liquid hydrocarbon component, and wherein at least one of the dimensions of the solid fuel material particles is of a similar size to or larger than the oxidizing agent particles so that a significant proportion of the oxidizing agent particles are not in contact with any solid fuel material particles whereby, in use, the solid fuel material is effective in substantially reducing the shock energy whilst increasing the heave energy so that the total energy per unit volume released remains comparable to a conventional high shock energy explosive of similar density.

It has been found that by substituting some or all of the liquid fuel oil with a slower burning solid fuel, the time during which the pressure builds up is lengthened, as much as fivefold, which significantly reduces the amount of shock energy produced.

Typically, the oxidizing agent is selected from ammonium nitrate, sodium nitrate, calcium nitrate, ammonium perchlorate or the like. The preferred oxidizing agent is ammonium nitrate.

Typically, the fuel material includes a fuel oil component, more typically, a diesel oil and may include mixtures of different oils. It is to be noted that fuel oils having a higher boiling point than diesel oil may be employed either in place of or in combination with the diesel oil. The preferred fuel oils should all be hydrocarbon fuels with very little or no nitrogen or oxygen being present.

In one preferred embodiment no fuel oil is employed, the fuel material being comprised entirely of solid fuel.

Typically the solid fuel is selected from the group comprising rubber, gilsonite, unexpanded polystyrene in solid form, acrylonitrile-butadiene-styrene (ABS), waxed wood meal, rosin and other suitable non-absorbent carbonaceous materials. Preferred solid fuels are rubber or unexpanded polystyrene, with rubber being the most preferred. The rubber may be selected from natural rubbers, synthetic rubbers, or combinations thereof.

Typically, the rubber is in the form of particles which are obtained from previously made rubber products, including natural or synthetic rubbers. Typically the buff produced in the process of retreading vehicle tires is used as the source of rubber particles. The buff could also be subjected to cryogenic freezing and then ground into particles. The particles are then screened to a desired predetermined size or particle size range. A preferred size range is from about 1–5 mm. It is desirable to avoid a bi-modal grist. Preferably one of the dimensions of the rubber particles should be comparable to the size of the ammonium nitrate prills. It is also preferred that the particles be all more or less uniform in size.

As an alternative to the rubber particles or in addition thereto, gilsonite may be used as the solid fuel. It is preferred that the gilsonite be of a –30 mesh size.

Other materials which may optionally be added to the composition include binders, retardants, inert materials, fillers, or the like. One example of an inert material added to the composition of the present invention is silicon dioxide in the form of sand particles. It is thought that the sand particles act as heat sinks which delay the time taken for the explosive to reach its maximum energy.

Preferably, when making the explosive composition of the present invention, all components are typically added simultaneously to a single large mix tank from separate smaller holding and/or weighing tanks.

It is preferred that the combined amounts of fuel oil and rubber be from 6 to 9% by weight of the total weight of the explosive composition, more preferably 6 to 7% with the amount of fuel oil being from as low as 0% to 5% of the total weight.

It is further preferred in one embodiment that the low shock explosive composition of the present invention have a composition in which the AN:FO:solid fuel ratio is within the range from 94:2:4 to 96:1½:2½. It is thought that in said one embodiment the changes in the oil to solid ratio help to slow down the production of maximum energy by the explosive to a more controlled release by having excess oil present in the composition.

The viscosity of the oil added to the explosive mixture in one form of the present invention is thought to be important since the added oil will not only penetrate internally into the prilled particles of the oxidising agent but will also remain in contact with the outside surface of the prilled particles.

BRIEF DESCRIPTION OF THE DRAWINGS

Preferred embodiments of the present invention will now be described, by way of example only, with reference to the accompanying drawing in which.

DETAILED DESCRIPTION OF PREFERRED EMBODIMENTS

Figure 1:
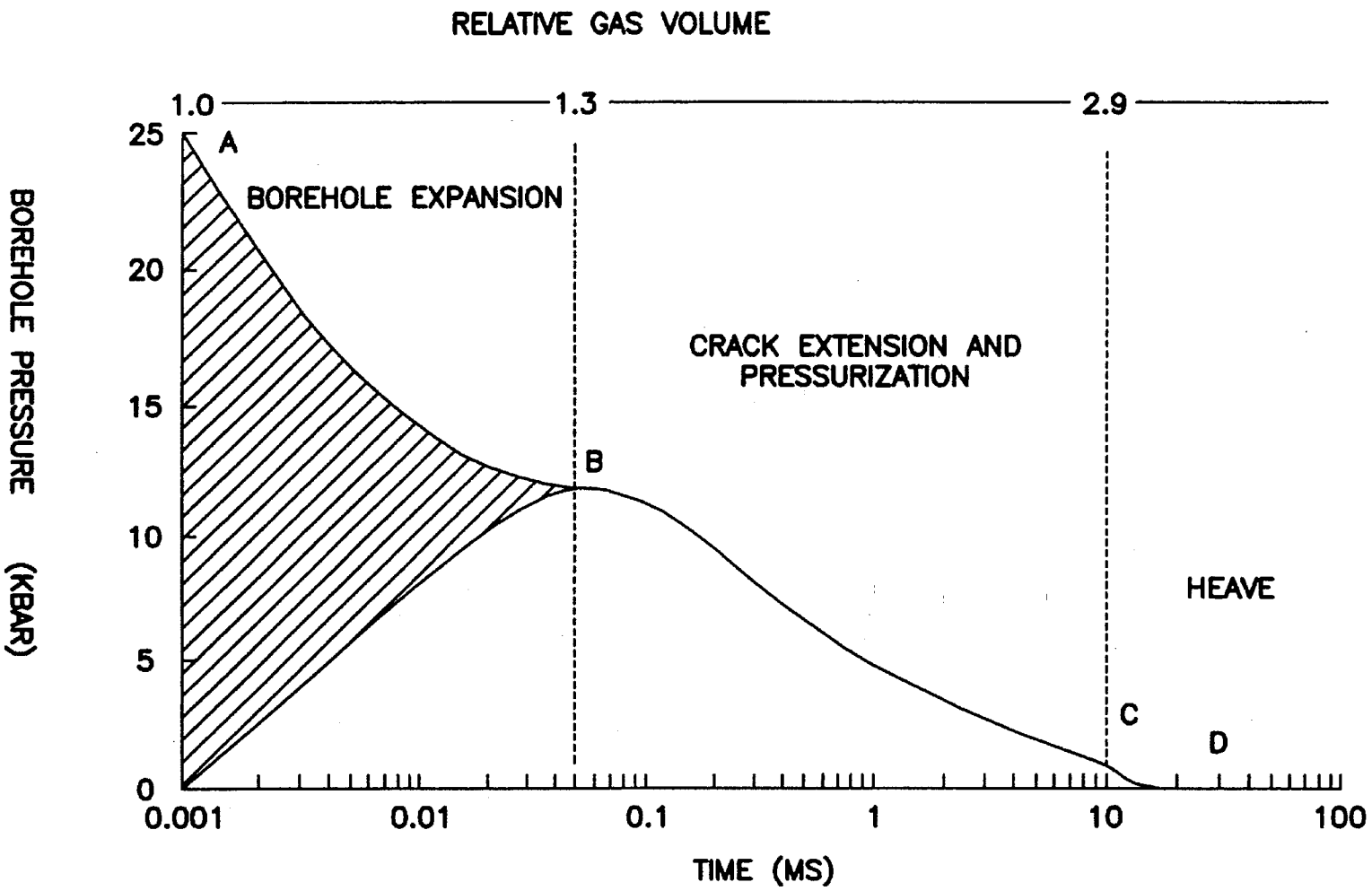
FIG. 1 is a plot of borehole pressure in Kilobar as a function of time in microseconds for a conventional explosive as represented by the curve OABCD as compared to that from one form of the explosive of the present invention as represented by the curve OBCD.

During blasting, an explosive located in a borehole is suddenly converted from its pre-blast state, such as for example, from a solid or liquid material existing at normal atmospheric pressure into a high pressure gas. On detonation of the explosive the massive instantaneous increase of pressure causes the borehole or blast hole to increase in size. The increase in size of the blast hole is caused by movement of the walls of the blast hole which movement in turn decreases the explosive gas pressure inside the blast hole. As the borehole diameter increases, restraining forces develop in the surrounding rock mass, and When the gas pressure has fallen to about one half of its initial value immediately after detonation further expansion of the borehole ceases. By this time, however, significant crushing and radial cracking have occurred in the rock structure in the vicinity of the borehole. As further time proceeds, the stress and crack fields developed in the rock structure extend outwardly from the bore hole until such time as large scale damage has occurred in the surrounding rock mass and the residual gas pressure is able to heave the rock burden forward to complete the effects of the blast. This sequence of events is illustrated in curve OABCD of FIG. 1, together with representative time intervals, where the curve portion OA corresponds to the instantaneous development of maximum energy or pressure, curve portion AB corresponds to the borehole expansion immediately after detonation and attendant reduction in pressure, curve portion BC corresponds to the crack extension and pressurisation stage as the pressure within the borehole reduces even further, and curve portion CD corresponds to the heave. Therefore, the sudden application of pressure and the development of maximum energy is represented by the line OA, and the subsequent borehole expansion and decrease in pressure is represented by curve ABCD.

Curve OBCD, on the other hand, illustrates the behaviour of one form of the low shock energy explosive of the present invention in which the development of maximum energy corresponding to detonation of the explosive and expansion of the borehole is controlled to be more gradual as can be seen by the relatively gentler slope of curve OB as compared to that of OA. The behaviour of the low shock energy explosive within the borehole after point B on the curve is reached is similar to that of conventional high shock energy explosives.

In FIG. 1, the shaded area OABO represents the energy which is propagated as a shock wave into the rock mass surrounding the borehole and is the amount of energy which is to be saved by using the explosive of the present invention as compared to conventional explosives since this energy is substantially wasted and furthermore damages the minerals being won from the rocks. For open pit mines, the insitu rock mass is often heavily jointed which leads to strong attenuation of the shock wave by frictional and other dissipative mechanisms. Thus, the shock energy is largely wasted energy, and does little else than lead to slope instability and other vibration caused problems.

Several exemplary embodiments of LSEE explosive compositions in the form of modified ANFO explosives will now be described with reference to the results of experimental tests performed on each composition.

EXAMPLE 1—ANRUB

It was originally believed that to ensure detonation when using a modified ANFO explosive some of the ammonium nitrate prills had to absorb fuel oil, or that they had to be intimately mixed at least. However, it has been found that it is not necessary to have any fuel in the prills. In this preferred embodiment, called ANRUB (Ammonium Nitrate/Rubber), no fuel oil is employed at all, the fuel for the reaction coming from the rubber itself acting as a solid fuel. In each of the following examples, commercially available explosive grade, porous AN prills were used having a mean prill diameter of between 1.0 to 2.0 mm.

Underwater Testing

Underwater testing of various compositions of ANRUB was performed in order to measure changes in the shock energy as well as in the heave energy. When an explosion takes place underwater, a shock wave is propagated through the water from the detonating explosive and in addition a gas bubble, which contains the gases evolved during the explosion, is formed. The internal energy of the gas in the bubble, or the bubble energy, is equivalent to the heave energy of the explosion in rock.

In the underwater testing three different sizes of rubber particle were employed in the explosive composition by sieving into the following sizes:

| | |
|---|---|
| COARSE | 100% passed 2.36 mm and 100% retained on 1.18 mm |
| MEDIUM | 100% passed 1.18 mm and 100% retained on 850 μm |
| FINE | 100% passed 850 μm. |

In addition, the underwater explosion was confined to simulate charge confinement in rock using two different types of confinement Light confinement—4 liter paint tins, weight 350 g.

Heavy confinement—101.7 mm i.d. steel tubes 500 mm long 6.3 mm wall thickness, weight 9200 g.

All charges were primed with HDP-3 boosters (approximately 140 g Pentolite) which was initiated with a No.8 AI detonator. The results of the underwater testing for ANRUB are summarised in Table 1. All compositions except where otherwise noted were oxygen balanced. The energy figures in brackets are the standard deviations.

TABLE 1

| | Paint Tin | | Steel Tube | |
|---|---|---|---|---|
| | CONFINEMENT: | | | |
| EXPLOSIVE: | Shock Energy SE j/g | Bubble Energy BE j/g | Shock Energy SE j/g | Bubble Energy BE j/g |
| ANFO (94/6) | 693 (87) | 2217 (50) | 810 (19) | 2044 (27) |
| ANRUB COARSE (93/7) | 440 (48) | 1659 (114) | 634 (6) | 1713 (39) |
| ANRUB MEDIUM (93/7) | 484 (31) | 1757 (84) | 739 (48) | 1828 (32) |
| ANRUB FINE (93/7) | 587 (51) | 1965 (102) | 732 (29) | 1914 (43) |
| ANRUB COARSE (96.5/3.5) | 454 (60) | 1477 (231) | | |
| ANRUB COARSE (89.5/10.5) | | 1713 (115) | 734 (23) | 1788 (32) |
| ANRUB COARSE (86/14) | 589 (70) | 1975 (187) | 734 (21) | 1780 (42) |
| ANRUB MEDIUM (96.5/3.5) | 374 (15) | 1545 (86) | | |
| ANRUB MEDIUM (89.5/10.5) | 477 (84) | 1841 (190) | | |
| ANRUB MEDIUM (86/14) | 570 (11) | 2063 (23) | | |

Even with heavy confinement it appears the underwater explosive reactions were incomplete due to the explosive not being held at a high enough density and pressure to react completely as the bubble of explosive gases expand. Hence, although the shock energy is lower in each case than for ANFO, the bubble energy is also lower as the full bubble energy was not developed. Subsequent testing in rock, where the gaseous explosive products are contained and confined for much longer so that the reactions go to completion, confirmed that ANRUB acts as a true LSEE. In rock where the explosive gases cannot expand as freely as they do in water the slower reacting solid fuel mixtures have more time to react completely, thus increasing the effective bubble or heave energy. However, the shock energy would not be expected to change significantly as it is a function of the initial detonation velocity and pressure at the detonation front—not the subsequent expansion of the gases.

The size of the rubber particles affects the rate at which the explosive reacts, suggesting that it is the intimacy between the solid fuel and the ammonium nitrate prills that controls the rate at which the explosive mixture reacts. Fine rubber reacts faster than the coarse rubber, as would be expected from a surface to mass ratio for the two grades of rubber particles. However, the smaller the fuel size, the higher the shock energy, and therefore a compromise may need to be found to obtain an optimum, by which all the fuel has time to react but at a rate slow enough to give decreased shock energy.

A problem with using rubber particles is that of segregation. Any fine rubber particles tend to segregate to the bottom of the mixture and affect the reaction. Rubber particles that are too coarse tend to float on top of the mixture. Coarse rubber particles were found to mix more uniformly with the ammonium nitrate prills. The addition of water or saturated AN solution during mixing of the AN/RUB was also found to significantly enhance the uniformity of the mixture, particularly with finer rubber particles.

Rock Testing

A shock wave is necessary for the initiation of detonation within a column of explosive. The intensity of the required shock wave is dependent upon the sensitivity of the explosive. Once the detonation process commences, a shock front propagates along the length of the charge. The speed with which this shock front moves through the explosive is known as the velocity of detonation (VOD) of the explosive. The theory of the LSEE according to the invention is based upon slowing the rate of reaction for a detonating explosive. The faster an explosive reacts, the larger the amount of shock energy produced. The shock energy is proportional to the square of the VOD. Hence a decrease in the VOD indicates a decrease in the shock energy. Both single hole and multiple hole firings in rock were conducted in order to confirm that ANRUB is characterised by both a reduction in the shock energy (reduced VOD) and an increase in the heave energy.

The detonation velocities were all found by the technique of measuring the time for the detonation front to short out pairs of wires at half meter intervals along the explosive charge. They are listed for various hole sizes, rock types and for both ANFO and ANRUB in Table 2.

TABLE 2

| Rock | Hole Diameter (mm) | Explosive: ANFO | Explosive: ANRUB |
|---|---|---|---|
| | | Detonation Velocities (m/s) | |
| Iron Ore | 381 | 4370 | 3960 |
| | | 4380 | 3900 |
| | 150 | | 3300 |
| Soft Iron Ore | 381 | 4350 | 3910 |
| Granite | 89 | 3550 | 2600 |

The figures in Table 2 indicate that ANRUB produces a consistently lower VOD compared to ANFO. However, a reduction in the VOD of an explosive is only partial confirmation that the explosive has the desired low shock energy characteristics. The vibrations produced by detonating ANRUB must also be reduced with respect to ANFO. Vibration measurement were made both at a Mt. Tom Price mine site and at a local quarry facility.

QUARRY

Vibration measurements were taken with two triaxial geophone assemblies, placed 10 and 20 meters back from the face, and perpendicular to the face, halfway between the two 89 mm blast holes. The rock type was granite.

TABLE 3

| Distance (m) | Explosive: ANFO | Explosive: ANRUB | ANFO/ANRUB |
|---|---|---|---|
| | Peak Particle Velocity (mm/s) | | |
| 10 | 756 | 426 | 1.77 |
| 20 | 127 | 73 | 1.75 |

TOM PRICE

Three geophone assemblies were positioned 15 meters behind the blast, parallel to the face. One geophone was placed one quarter of the way along the blast. The second behind the centre of the blast, and the third, three quarters of the way along the blast. One half of the blast was charged with ANFO and the other with ANRUB.

The first test was in soft iron ore using 381 mm diameter holes, 15 m high bench and 2 m subgrade. The blasthole to geophone distances ranged from 15 to 60 meters. The average burden was 7.8 meters and the average spacing was 9.0 meters, with a stemming depth of 9 meters. The blast consisted of 12 holes along the face, and was two rows deep.

Correlation of measurements of the vector sum of the radial and transverse particle velocities show:

$$\text{ANFO } ppv = \frac{96.24}{\frac{R}{b}} \text{ exp. } \left(-0.0052 \frac{R}{b}\right) \text{ m/s}$$

$$\text{ANRUB } ppv = \frac{76.00}{\frac{R}{b}} \text{ exp } \left(-0.00488 \frac{R}{b}\right) \text{ m/s}$$

where

R is the distance from the blasthole to the geophone assembly, b is the blasthole radius and, ppv is the peak particle velocity, 96.24 and 76.00 are the ppv at the blasthole wall for ANFO and ANRUB respectively, and 0.0052 and 0.00488 are the attenuation coefficients for ANFO and ANRUB respectively.

The ratio of the ppv between ANFO and ANRUB is:

$$\frac{\text{ANFO}}{\text{ANRUB}} = 1.266$$

The second test was in iron ore using 381 mm diameter holes. The geophone arrays were the same as above. The average burden was 8.8 meters and the average spacing was 10.2 meters, with a stemming depth of 8 meters. The blast consisted of 14 holes along the face, and was two rows deep.

$$\text{ANFO } ppv = \frac{81.97}{\frac{R}{b}} \text{ exp. } \left(-0.00866 \frac{R}{b}\right) \text{ m/s}$$

$$\text{ANRUB } ppv = \frac{58.06}{\frac{R}{b}} \text{ exp. } \left(-0.00377 \frac{R}{b}\right) \text{ m/s}$$

The ratio of the ppv between ANFO and ANRUB is:

$$\frac{\text{ANFO}}{\text{ANRUB}} = 1.412$$

The vibration measurements indicate that ANRUB displays a consistently lower vibration characteristic than comparable ANFO, thus confirming that ANRUB has the desired low shock energy characteristics.

In order to determine whether ANRUB has a comparable total energy to ANFO, it is also necessary to measure the heave energy. If the shock energy of ANRUB is reduced With respect to ANFO, for the total energy to be preserved, the heave energy must consequently increase. Although heave energy can not be measured directly, it is directly related to the burden velocity. In order to measure heave velocities, high speed photography was taken at 500 fps, which is suitable for back analysis to determine heave velocities. There are two main components of heave velocity—face and crest.

The initial vertical heave velocities were calculated by analysing high speed 16 mm film of the blast. Markers (witches hats and paint cans) were placed on the crest. Their subsequent motion reflects the velocity of the crest caused by the explosive.

TABLE 4

| Explosive | Velocities (m/s) | | | | Average (m/s) |
|---|---|---|---|---|---|
| ANFO | 4.00 | 3.97 | 3.37 | 4.00 | 3.84 |
| ANRUB | 4.89 | 6.27 | 4.54 | | 5.23 |

The ratio of average heave velocities $$\frac{\text{ANFO}}{\text{ANRUB}} = 1.36$$

Explosive Classification of ANRUB

Explosive regulations restrict the mixing of explosives, such as ANFO, to being prepared at the top-of-the-hole. That is, the fuel oil is added to the ammonium nitrate prills just prior to the mixture being pumped down the hole. The time required to obtain a uniform mix of ANRUB does not permit mixing the produce at the top-of-the-hole. These same regulations prohibit the transport of bulk explosives, which means that ANRUB cannot be pre-mixed and transported to the hole under the current explosive classification.

To overcome this problem, it was decided to attempt to classify ANRUB in Hazard Division 1.5. Only "very insensitive" explosive substances can be classified as 1.5D. In order to evaluate whether an explosive composition is "very insensitive" it must pass the Series 5 tests outlined below. The Series 5 tests consist of four different types of tests:

Type 5(*a*): Cap Sensitivity Test—a shock test which determines the sensitivity to detonation by a standard detonator.

Type 5(*b*): Deflagration to Detonation Tests—thermal tests which determine the tendency of transition from deflagration to detonation.

Type 5(*c*): External Fire Test—essentially a test to determine if a substance, when in large quantities, explodes when subjected to a large fire.

Type 5 (*d*): Princess Incendiary Spark Test—to determine if a substance ignites when subjected to a incendiary spark.

ANRUB passed all four tests and has been authorised as ANRUB, UN No. 0082 classification 1.5D, Category (ZZ). This means it can be pre-mixed and transported in bulk, thus providing much greater flexibility to the mixing and transportation of ANRUB.

EXAMPLE 2—ANFORB

An alternate embodiment of the present invention which is known as ANFORB (Ammonium Nitrate/Fuel Oil/Rubber) simulates semi-gelatinous explosives which consist of about 10% of a thin reactive layer of nitroglycerine spread over crystals of ammonium nitrate (AN) and a solid fuel. Detonation of the nitroglycerine initiates a reaction between the AN and fuel which in turn provides the energy for rock breakage. ANFORB simulates semi-gelatinous explosives in the sense that it uses ANFO to initiate a reaction between AN and rubber particles as solid fuel. In this embodiment 30% of 94:6 ANFO explosive is selected and combined with 70% of a 93:7 AN/Rubber material to form a slow burn explosive. The 30% of ANFO is used as the initiator for the combination whereas the 93:7 AN/Rubber material is used to provide for the controlled development of maximum energy. This represents 93% AN, 2% fuel oil and 5% rubber in the ANFORB. The AN/FO/RUB ratio can be altered to obtain the optimum composition.

Underwater testing indicates that ANFORB has similar explosive properties to ANRUB, producing an average bubble energy of 1957±147 J/g. As a slight deviation from the initial ANFORB in which the solid and liquid fuels are added separately to the Drills, ROIL was tested. ROIL consists of pre-mixing the solid and liquid fuels prior to their addition to the AN prills. Underwater tests on ROIL also produced results comparable to ANRUB, with an average shock energy of 593±62 J/g and a bubble energy of 1898±117 J/g.

EXAMPLE 3—ANPS

Two different forms of unexpanded polystyrene were tested as solid fuels for a LSEE called ANPS (Ammonium-Nitrate/Polystyrene). The first comes in the form of cylindrical polystyrene beads, a few millimeters long with a diameter of about 2 mm. Experiments on this mixture underwater resulted in an average shock energy of 314±88 J/g and a bubble energy of 1268±149 J/g. The beads tend to segregate from the prills to form a non-uniform mixture. In addition, the energies released are quite low, indicating a very slow rate of reaction. It is probable, however, that under the confinement of a steel tube these energies would increase significantly.

The second form is that of polystyrene flakes. These have a larger surface area per unit mass than the beads and therefore they should react faster. The measured underwater shock energy for the ANPS flake is 330±79 J/g with a corresponding bubble energy of 1299±181 J/g. A problem lies in the sizes of the flakes; those that are too small settle to the bottom of the mix and those that are too large float on top of the mixture. By sieving the flakes into definite size distributions, the fraction that mixes well can be used to provide a uniform explosive mix.

ANPS flakes have been experimented upon underwater, with confinement being provided by a steel tube. As expected, the shock and bubble energies rose to the values of 545±33 J/g and 1616±75 J/g respectively. Confinement of the charge has resulted in an increase in the combined bubble and shock energies of over 500 J/g, which is significant. There is still uncertainty as to whether the explosive has reacted completely. If the explosive reactions are incomplete, then it is likely that when confined in rock the bubble/heave energy will increase, giving ANPS the properties of a true LSEE in accordance with the invention.

EXAMPLE 4—ANPW

ANPW is a mixture of ammonium nitrate, sawdust and paraffin wax. Two different sized sawdust samples were taken, denoted fine and coarse. The sawdust and liquid paraffin wax are mixed together to form paraffin wax coated, sawdust particles. Upon cooling the mixtures down, they formed a cake in the bottom of the mixing container; this was difficult to break up. Mixing the solid fuel paraffin wax coated sawdust particles and ammonium nitrate together was not too difficult and the underwater testing gave shock energies of 540±29 J/g and 474±53 J/g for the fine and coarse samples respectively. The heave energies for the fine and coarse samples are 1915±38 J/g and 1862±38 J/g respectively.

EXAMPLE 5—HANRUB

Heavy ANFO's are high energy, high density explosives. Their main advantages are their higher density and subsequent higher bulk strength. Another advantage is that Heavy ANFO's are water resistant, depending upon their composition. This is ideal for sites where water intersects the blastholes and hence some of the holes are partially filled with water. In addition, rainwater does not dissolve or deteriorate the product once it is loaded.

Heavy ANFO's consist of an oxygen balanced mixture of Ammonium Nitrate, Fuel Oil and emulsion e.g. High Energy Fuel (HEF) or (ENERGAN). The HEF or ENERGAN phase has a high density and coats the surface of the AN prills, filling up the interstices between the prills with a resultant increase in the density of the product.

HANRUB is a Heavy Explosive which consists of an oxygen balanced mixture of Ammonium Nitrate, Rubber and an Emulsion phase. The aim is to produce an explosive with the following properties:

High density

High gas energy

Low shock energy

The explosive also has a degree of water resistance, depending upon the amount of emulsion in the mixture. When the emulsion completely fills the voids between the prills and the rubber, a degree of water resistance is obtained.

HEF 001 is 75% Ammonium Nitrate, 3.1% Fuel Oil and 21.9% HEF. It loads down a 381 mm hole at 121 $kgm^{-1}$, a density of 1.06 $gcm^{-3}$. The HANRUB equivalent, 75% Ammonium Nitrate, 3.1% Rubber and 21.9% emulsion, has a loading density of 0.88 $gcm^{-3}$, or 100 $kgm^{-1}$ in a 381 mmhole.

Two holes of HEF 001 and two for HANRUB were detonated during the field trials at Tom Price. High speed photography of the blasts was analysed and the following results obtained.

TABLE 5

| Explosive | Heave Velocity (m/s) |
|---|---|
| HEF 001 | 6.19 |
| HANRUB | 7.71 |

Giving the ratio of the average heave velocities $\frac{\text{HANRUB}}{\text{HEF001}} = 1.25$ The above figures indicate that the heave velocity and hence the heave energy for HANRUB is indeed increased compared to HEF001, by a similar factor as ANRUB when compared to ANFO.

Higher density, Heavy Explosives can be produced by increasing the percentage of emulsion in the mixture. A 60/40 ANFO/emulsion mixture has a density around 1.2 $gcm^{-3}$. Increasing the HEF content of HANRUB, will consequently increase the density of the product. There is a limit to the maximum density possible with Heavy Explosives, that is, when all the voids between the prills are filled with emulsion, of approximately 1.3 $gcm^{-3}$.

Now that several examples of the explosive composition according to the invention have been described in detail, it will be apparent that the use of a solid fuel in accordance with the invention can produce the desired LSEE. In a conventional ANFO explosive composition, the liquid fuel is absorbed by the porous grade ammonium nitrate (AN) prills. In a preferred form of the invention, in which all of the liquid fuel is replaced with a solid fuel, less porous or even crystalline AN, which is less expensive than Porous AN prills, can be used. This has the advantage of lowering the cost of the explosive.

Other advantages of the preferred LSEE of the present invention include the following:

1. A relative increase in the heave energy with respect to the shock energy will lead to a more efficient rock blasting explosive.
2. This increase in efficiency will result in a reduction in the amount of explosive needed per hole to produce similar explosive results, which will produce a cost saving.
3. There is an increase in the stability of the slopes and a reduction in ground vibration thus making the LSEE more "environmentally friendly".
4. There is a decrease in the amount of fines produced.
5. There is a reduction in the amount of damage done to the minerals being mined, particularly diamonds.
6. Due to the relative insensitivity to inadvertent explosion of the LSEE it can be pre-mixed and transported in bulk to the mine site and around the mine site.

The described Examples have been advanced by way explanation and many modifications may be made without departing from the spirit and scope of the invention which includes every novel feature and novel combination of features herein disclosed.

Those skilled in the art will appreciate that the invention described herein is susceptible to variations and modifications, other than those specifically described, without departing from the basic principles of the invention. All such variations and modifications are considered to be within the scope of the present invention, the nature of which is to be determined from the foregoing description and the appended claims.

We claim:

1. An explosive composition comprising an oxidizing agent in solid particulate form and a fuel materials, wherein said fuel material includes a nonabsorbent solid fuel material incorporated into the composition in particulate form, the weight ratio of the oxidizing agent to the fuel material being in the range of 85:15 to 99:1, and the percentage by weight of the solid fuel material being set between 1 to 15% of the total weight of the composition, the balance, if any, of the fuel material comprising a liquid hydrocarbon component, and wherein at least one of the dimensions of the solid fuel material particles is of a size relative to the oxidizing agent particles such that a significant proportion of the oxidizing agent particles are not in contact with any solid fuel material particles whereby, in use, the solid fuel material is effective in reducing the shock energy whilst increasing the heave energy so that the total energy per unit volume released remains comparable to a conventional high shock energy explosive of similar density.

2. An explosive composition as defined in claim 1, wherein the weight ratio of the oxidizing agent to the fuel material is in the range of 86:14 to 96.5:3.5, and wherein the fuel material is substantially entirely a solid fuel material.

3. An explosive composition as defined in claim 1, wherein the weight ratio of the oxidizing agent to the fuel material is in the range 92:8 to 94:6, and wherein the fuel material is substantially entirely a solid fuel material.

4. An explosive composition as defined in claim 1, wherein the oxidizing agent is selected from the group consisting of ammonium nitrate, sodium nitrate, calcium nitrate, ammonium perchlorate and mixtures thereof.

5. An explosive composition as defined in claim 4, wherein the solid fuel material is selected from the group consisting of rubber, unexpanded polystyrene, gilsonite, wax coated sawdust, ABS, rosin, and other suitable non-absorbent carbonaceous materials.

6. An explosive composition as defined in claim 1, wherein said oxidizing agent is in the form of ammonium nitrate (AN) prills and said fuel material is a solid fuel material in the form of rubber particles (RUB), in which the weight ratio of AN:RUB is in the range 92:8 to 94:6.

7. An explosive composition as defined in claim 6, wherein said rubber particles are of a size that is capable of substantially passing through a 3 mm sieve but are substantially retained on a 500 μm sieve.

8. An explosive composition as defined in claim 6, wherein said rubber particles are of a size that is capable of substantially passing through a 2.36 mm sieve but are substantially retained on a 850 μm sieve.

9. A method of preparing an explosive composition, the method comprising mixing an oxidizing agent in solid particulate form and a fuel material, wherein said fuel material includes a non-absorbent solid fuel material incorporated into the composition in particulate form, the weight ratio of the oxidizing agent to the fuel material being in the range of 85:15 to 99:1, and the percentage by weight of the solid fuel material being set between 1 to 15% of the total weight of the composition, the balance, if any, of the fuel material comprising a liquid hydrocarbon component, and wherein at least one of the dimensions of the solid fuel material particles is of a size relative to the oxidizing agent particles such that a significant proportion of the oxidizing agent particles are not in contact with any solid fuel material particles whereby, in use, the solid fuel material is effective in reducing the shock energy whilst increasing the heave energy so that the total energy per unit volume released remains comparable to a conventional high shock energy explosive of similar density.

10. A method as defined in claim 9, wherein the weight ratio of the oxidizing agent to the fuel material is in the range of 86:14 to 96.5:3.5.

11. A method as defined in claim 9, wherein said fuel material is selected from the group consisting of rubber, unexpanded polystyrene, gilsonite, wax coated sawdust, ABS, rosin, and other suitable non-absorbent carbonaceous materials.

12. A method as defined in claim 9, wherein said fuel material is selected from the group consisting of rubber, unexpanded polystyrene, gilsonite, wax coated sawdust, ABS, rosin, and other suitable non-absorbent carbonaceous materials.

13. A method as defined in claim 9, wherein the oxidizing agent is in the form of ammonium nitrate (AN) prills and said fuel material is a solid fuel in the form of rubber particles (RUB), and the weight ratio of AN:RUB is in the range 92:8 to 94:6.

14. A method as defined in claim 13, wherein the rubber particles are of a size that is capable of substantially passing through a 3 mm sieve but are substantially retained on a 500 μm sieve.

15. An explosive kit including a first component comprising an oxidizing agent in solid particulate form and a second component comprising a fuel material, said fuel material including a non-absorbent solid fuel material in particulate form, the weight ratio of the oxidizing agent to the fuel material being in the range of 85:15 to 99:1, and the percentage by weight of the solid fuel material being set between 1 to 15% of the total weight of the composition, the balance, if any, of the fuel material comprising a liquid hydrocarbon component, and wherein at least one of the dimensions of the solid fuel material is of a size relative to the oxidizing agent particles such that in an explosive composition obtained by mixing the first and second components a significant proportion of the oxidizing agent particles are not in contact with solid fuel material particles whereby, in use, the solid fuel material is effective in reducing the shock energy whilst increasing the heave energy so that the total energy per unit volume released remains comparable to a conventional high shock energy explosive of similar density.

16. An explosive kit as defined in claim 15, wherein the weight ratio of the oxidizing agent to the fuel material is in the range of 86:14 to 96.5:3.5.

17. An explosive kit as defined in claim 15, wherein said oxidizing agent is selected from the group consisting of ammonium nitrate, sodium nitrate, calcium nitrate, ammonium perchlorate and mixtures thereof.

18. An explosive kit as defined in claim 15, wherein said fuel material is selected from the group consisting of rubber, unexpanded polystyrene, gilsonite, wax coated sawdust, ABS, rosin, and other suitable non-absorbent carbonaceous materials.

19. An explosive kit as defined in claim 15, wherein the oxidizing agent is in the form of ammonium nitrate (AN) prills and said fuel material consists of a solid fuel in the form of rubber particles (RUB), and the weight ratio of AN:RUB is in the range 92:8 to 94:6.

20. An explosive kit as defined in claim 19, wherein the rubber particles are of a size that is capable of substantially passing through a 2.36 mm sieve but are substantially retained on a 850 μm sieve.

21. A method of blasting, which method comprises providing a required volume of an explosive composition comprising an oxidizing agent is solid particle form and a fuel material, wherein said fuel material includes a non-absorbent solid fuel material incorporated into the composition in particulate form, the weight ratio of the oxidizing agent to the fuel material being in the range of 85:15 to 99:1, and the percentage by weight of the solid fuel material is set between 1 to 15% of the total weight of the composition, the balance, if any, of the fuel material comprising a liquid hydrocarbon component, and wherein at least one of the dimensions of the solid fuel material particles is of a similar size to or larger than the oxidizing agent particles so that a significant proportion of the oxidizing agent particles are not in contact with any solid fuel material particles whereby, in use, the solid fuel material is effective in substantially reducing the shock energy whilst increasing the heave energy so that the total energy per unit volume released remains comparable to a conventional high shock energy explosive of similar density.

22. An explosive composition comprising ammonium nitrate prills as an oxidizing agent and rubber as a fuel material, wherein said fuel material is substantially entirely a non-absorbent solid fuel material incorporated into the composition in particulate form, the weight ratio of the ammonium nitrate prills to the rubber particles being in the range of 92:8 to 94:6, and the percentage by weight of the solid fuel material being set between 1 to 15% of the total weight of the composition, the rubber particles being of a size that is capable of substantially passing through a 2.36 mm sieve but being retained on a 850 mm sieve and the ammonium nitrate prills having a mean prill diameter of between 1.0 to 2.0 mm, and wherein at least one of the dimensions of the rubber particles is of a size relative to the ammonium nitrate prille such that a significant proportion of the ammonium nitrate prills are not in contact with any rubber particles whereby, in use, the solid fuel material is effective in reducing the shock energy whilst increasing the heave energy so that the total energy per unit volume released remains comparable to a conventional high shock energy explosive of similar density.

23. An explosive composition as defined in claim 8, wherein said ammonium nitrate has a mean prill diameter of between 1.0 to 2.0 mm.

24. A method as defined in claim 14, wherein the ammonium nitrate has a mean prill diameter of between 1.0 to 2.0 mm.

25. An explosive kit as defined in claim 20, wherein the ammonium nitrate has a mean prill diameter of between 1.0 to 2.0 mm.

* * * * *